US008757619B2

(12) United States Patent
Myers, IV

(10) Patent No.: US 8,757,619 B2
(45) Date of Patent: Jun. 24, 2014

(54) VARIABLE MODE BATTING PRACTICE ASSEMBLY

(76) Inventor: Peter Evans Myers, IV, Moncks Corner, SC (US)

( * ) Notice: Subject to any disclaimer, the term of this patent is extended or adjusted under 35 U.S.C. 154(b) by 1032 days.

(21) Appl. No.: 12/803,290

(22) Filed: Jun. 23, 2010

(65) Prior Publication Data

US 2010/0331124 A1 Dec. 30, 2010

Related U.S. Application Data

(60) Provisional application No. 61/269,907, filed on Jun. 30, 2009.

(51) Int. Cl.

| | |
|---|---|
| ***A63B 57/00*** | (2006.01) |
| ***A63B 69/40*** | (2006.01) |
| *A63B 69/00* | (2006.01) |

(52) U.S. Cl.

CPC ..... *A63B 69/40* (2013.01); *A63B 2069/0008* (2013.01); *A63B 69/0053* (2013.01)

USPC ..... 273/108.31; 273/108; 273/108.3; 273/108.51; 273/120 R; 273/120 A; 473/499

(58) Field of Classification Search

USPC ..... 273/108.3, 108.31; 473/499

See application file for complete search history.

(56) References Cited

U.S. PATENT DOCUMENTS

| | | | | |
|---|---|---|---|---|
| 3,677,544 | A * | 7/1972 | Meyers et al. | 473/451 |
| 4,830,372 | A * | 5/1989 | Outlaw et al. | 124/16 |
| 5,066,010 | A * | 11/1991 | Pingston | 473/451 |
| 5,558,324 | A * | 9/1996 | Jourdan | 124/83 |
| 6,616,555 | B2 * | 9/2003 | Bewley | 473/451 |
| 6,974,396 | B2 | 12/2005 | Mauer et al. | |
| 7,182,705 | B2 | 2/2007 | Lin | |
| 7,458,907 | B2 | 12/2008 | Wang | |
| 7,722,485 | B2 * | 5/2010 | Balasubramanyan | 473/422 |
| 2003/0069092 | A1 | 4/2003 | Gowan et al. | |
| 2004/0138011 | A1 | 7/2004 | Lin | |
| 2004/0266562 | A1 | 12/2004 | Gowan et al. | |
| 2006/0003857 | A1 | 1/2006 | Mauer et al. | |
| 2008/0234077 | A1 * | 9/2008 | Glowinski | 473/570 |
| 2009/0227401 | A1 | 9/2009 | Mauer et al. | |

OTHER PUBLICATIONS

Cognitive brain research, ISSN 0926-6410; 2005, vol. 22, p. 257 Abstract Elsevier Science, Amsterdam, PAY-BAS (1992-2005).

(Continued)

*Primary Examiner* — Ronald Laneau
*Assistant Examiner* — Justin Myhr

(57) ABSTRACT

A batting practice assembly includes a controller-power system, and preferably two ball chutes on a slide bar assembly of a ball release apparatus, which is mounted on a height adjustable frame assembly. Four modes of operation are initiated by a foot-activated mechanism of the practice assembly: I-Ball drops from one ball chute; II-Ball drops randomly from either chute; III-Ball drops randomly from either or neither chute; and IV-Random ball drop from either or neither chute, or ball drops with a slight delay from either chute. Difficulty can be increased by adjusting the height of the ball chutes, increasing the distance between the chutes, or changing the angle of the chutes in relation to the hitter. Along with hitting mechanics, the decision-making aspects of hitting and in swing adjustments are developed using the practice assembly. This simplified abstract is not intended to limit, and should not be interpreted as limiting, the scope of the claims.

20 Claims, 11 Drawing Sheets

(56) References Cited

OTHER PUBLICATIONS

Sport Specific Practice More Important than Simple Reaction Time; Sports Performance Journal; Mar. 25, 2005.
Kida Noriyuki, Oda Shingo, Matsumura Michikazu; Intensive baseball practice improves the Go/Nogo reaction time, but not the simple reaction time; Cognitive brain research, ISSN 0926-6410; 2005, vol. 22, p. 257 Abstract Elsevier Science, Amsterdam, PAY-BAS (1992-2005) Article was accessed from the Internet Oct. 16, 2008.
Sports Specific Practice More Important than Simple Reaction Time; Sports Performance Journal; Mar. 25, 2005.

* cited by examiner

Mode I

OR

Mode II

VARIABLE MODE BATTING PRACTICE ASSEMBLY

CROSS REFERENCE TO RELATED DOCUMENT

Benefit is claimed under 35 USC 119(e) of the filing date of provisional U.S. patent application No. 61/269,907, filed on Jun. 30, 2009 and entitled "Batting Practice Assembly".

BACKGROUND OF THE INVENTION

1. Technical Field

The present invention relates generally to a variable mode training assembly for improving ball hitting skills, such as hitting a baseball or other ball with a bat or the like.

2. Background Information

Baseball training devices, or assemblies, for improving a player's hitting skills fall into several categories. The most common type of training device has a stationary ball. These include variations of the simple hitting tee. This "stationary ball" category also includes devices with the ball attached to an anchored pivot, so that when the ball is hit, it rotates around the central pivot point. Other practice devices suspend the ball with multiple elastic bands, which return the ball to its original position after being hit.

A second category of batting practice assemblies features a moving ball. This "moving ball" category includes "soft-toss" machines, which have a ball that moves upward before falling into the hitting zone. Simple gravity drop devices usually have tubing through which the ball rolls before it drops from an exit portal. These "moving ball" devices are ordinarily either "hand-fed" or utilize a timing mechanism to release balls at a predetermined constant rate.

It is believed that commercially available stationary ball and moving ball practice assemblies really only benefit hitters with few or marginal hitting skills, such as beginners. Once a user has basic skills, it is believed herein that training with such practice devices does not lead to improvements during an actual game because such devices do not challenge a hitter's decision making reaction time or in-swing adjustments.

In general, a hitter must either take or swing at each pitch offered. A hitter has only about 0.438 seconds to respond to a pitch that averages 84 miles per hour over the approximately 54 feet from release point to contact point. This translates to a release velocity of about 90-91 miles per hour, since all pitches lose 8 to 10 percent of initial velocity from release to contact. Thus, a hitter has only 0.438 seconds to: (1) analyze the pitch as to velocity, location, rotation, and movement; (2) process this information and decide to swing or not to swing (go/no go reaction time); and (3) get the sweet spot of the bat to the ball (swing time), if the decision is to swing.

If a hitter trains to begin a swing on every pitch and then decides to abort the swing, the time difference between swing time and abort time can be shifted forward to analysis time. Abort time will be shorter than swing time. The hitter then has more information about the pitch and is therefore more likely to hit it well. The present invention helps players to "lay off bad pitches", which commands a different mind set than asking a player to "find a good pitch to hit" or to "swing at strikes".

It is believed that use of the practice assembly of the present invention over time will shorten the go/no go reaction time by increasing the efficiency of neural pathways in the areas of the brain (anterior cingulate cortex, etc.) that regulate the decision-making process. It is also believed herein that a hitter's swing time will improve by eliminating unnecessary and time wasting mechanics, such as wrapping the bat behind the player's head, or not getting the front heel down quickly and firmly. As the hitter progressively goes to the more challenging modes of operation of this invention, he or she must eliminate time wasting mechanics in order to succeed. If a hitter can shorten his go/no go reaction time and his swing time, he or she now has more time to analyze the pitch. With consistent use of the present batting practice assembly, a player's ball hitting skills and game time performance should improve.

BRIEF SUMMARY OF THE INVENTION

The present invention is a variable mode batting practice assembly for challenging even advanced players, including: (a) an adjustable frame assembly comprising a substantially horizontal ball release arm portion, and a height adjustable, substantially vertical pole assembly attached at its upper end portion to the ball release arm portion; (b) a ball release apparatus supported on the ball release arm portion, the ball release apparatus comprising at least one ball drop mechanism and a slide bar assembly, each ball drop mechanism comprising: at least one ball chute, at least one ball catch arm adjacent the ball chute, and a catch arm mechanism in communication with the at least one ball catch arm, each ball drop mechanism being slideable on a slide bar of the slide bar assembly; (c) an electronic controller-power system in communication with the ball release apparatus, the controller-power system being powered by a power supply; and (d) a separate foot-activated mechanism in communication with the controller-power system; wherein activation of the foot-activated mechanism activates the ball release apparatus, which opens a bottom ball chute hole in the at least one ball chute.

Advantages of the batting practice assembly of the present invention include, but are not limited to, the following:

1. The present assembly challenges and benefits hitters of any initial skill level.
2. As the user's skill level improves, difficulty can be increased by small increments using the present batting practice assembly until the hitter feels that his or her maximum physical and mental (decision making) capabilities are reached. As hitters progress through the increasingly difficult modes of operation of the present invention, intense concentration is required in order to consistently "square-up" the ball.
3. The batting practice assembly of the present invention simulates "game time" challenges, such as velocity, location, off speed, movement, and taking pitch.
4. A minimum of space is needed to use and store the batting practice assembly of the present invention.
5. The batting practice assembly of the present invention can be used with conventional baseballs, dimple balls, whiffle balls, and the like.
6. With the batting practice assembly of the present invention, the hitter can use any desired pre-swing movements in order to maintain or develop his or her own hitting rhythm.
7. With the batting practice assembly of the present invention, the hitter has complete control of when the next "pitch" comes.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
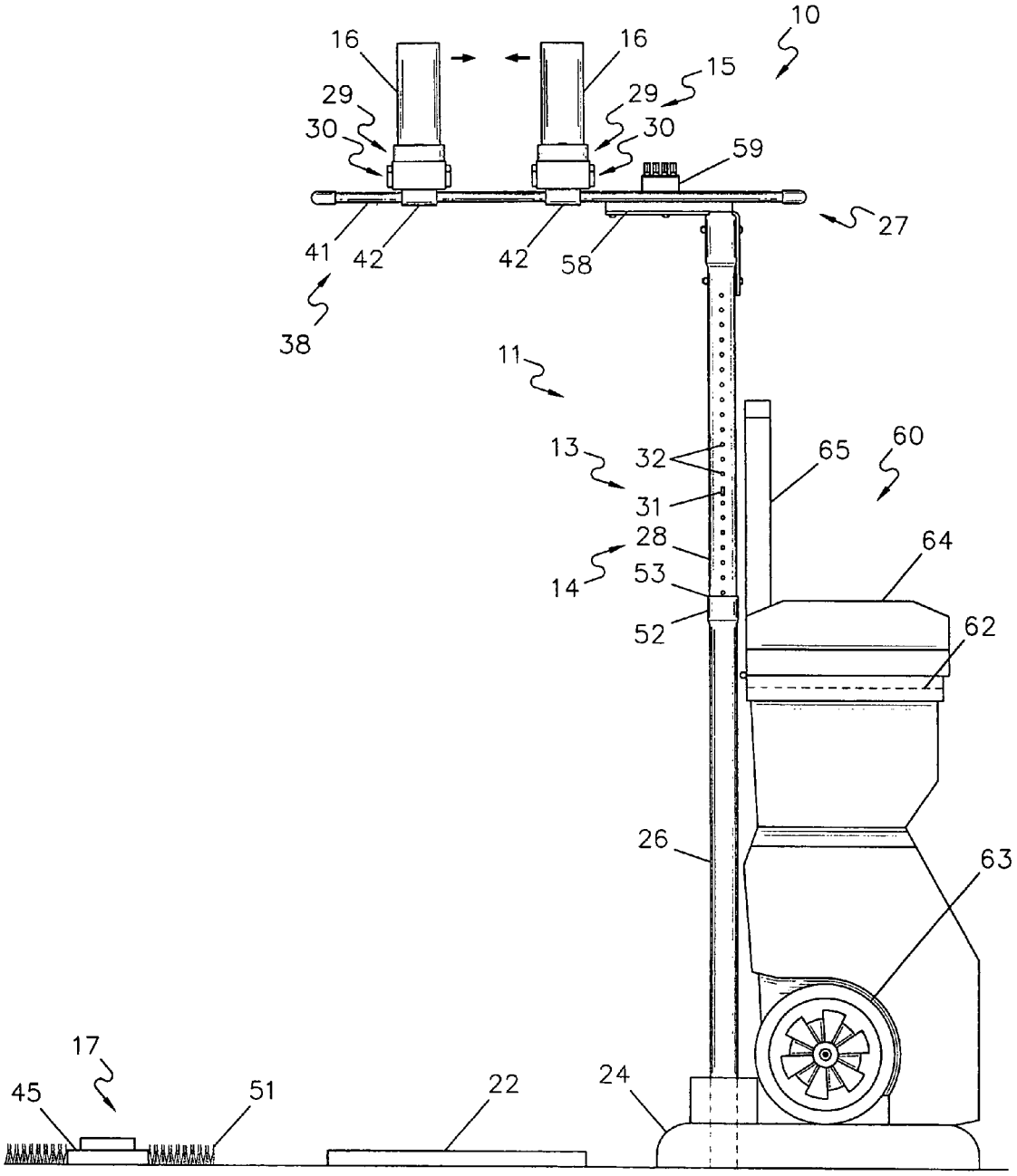
FIG. 1 is a side elevational view of a batting practice assembly according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, an assembly embodying the principles and concepts of the present invention and generally designated by the reference numeral 10 will now be described.

Figure 2:
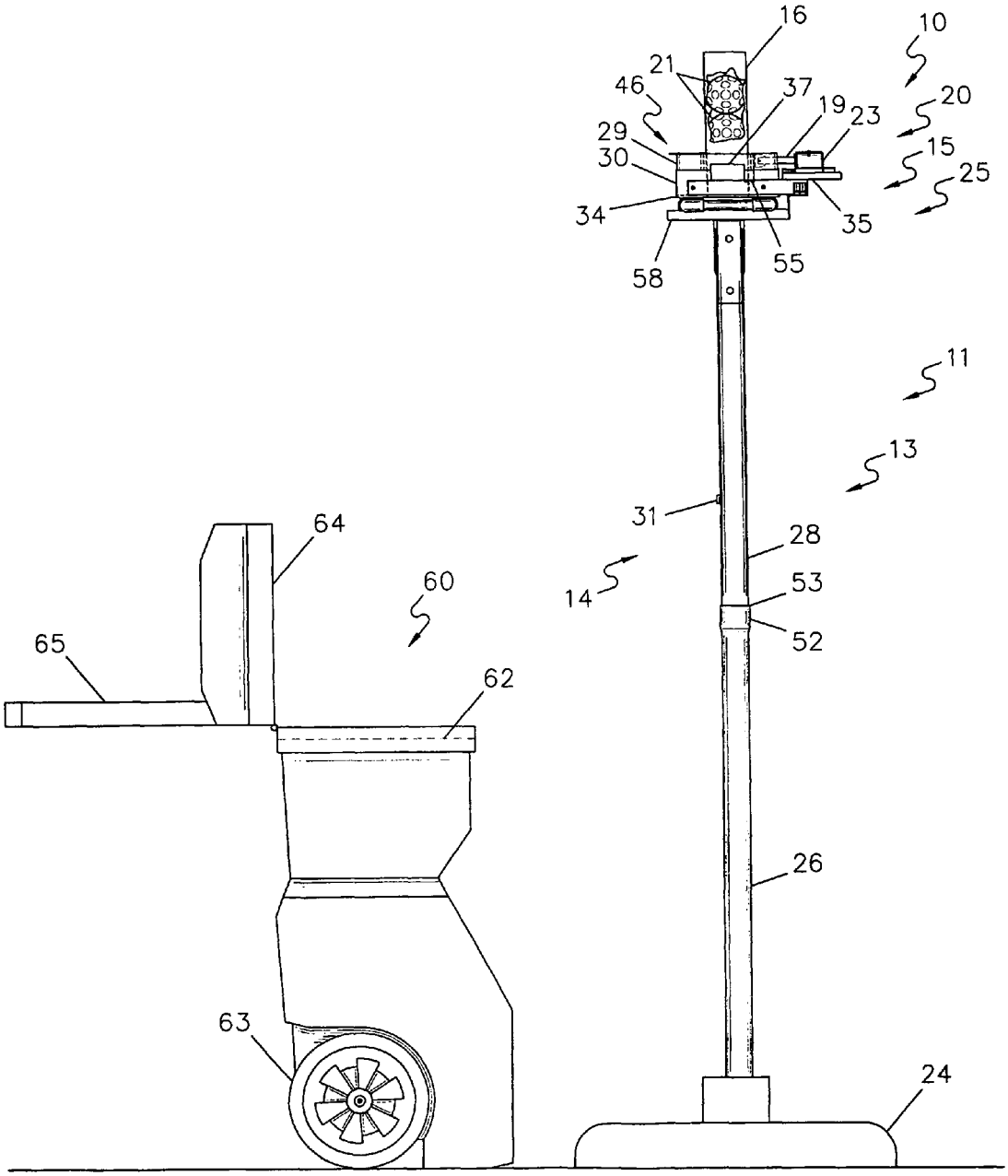
FIG. 2 is a rear perspective view of the batting practice assembly according to the present invention.
Figure 3:
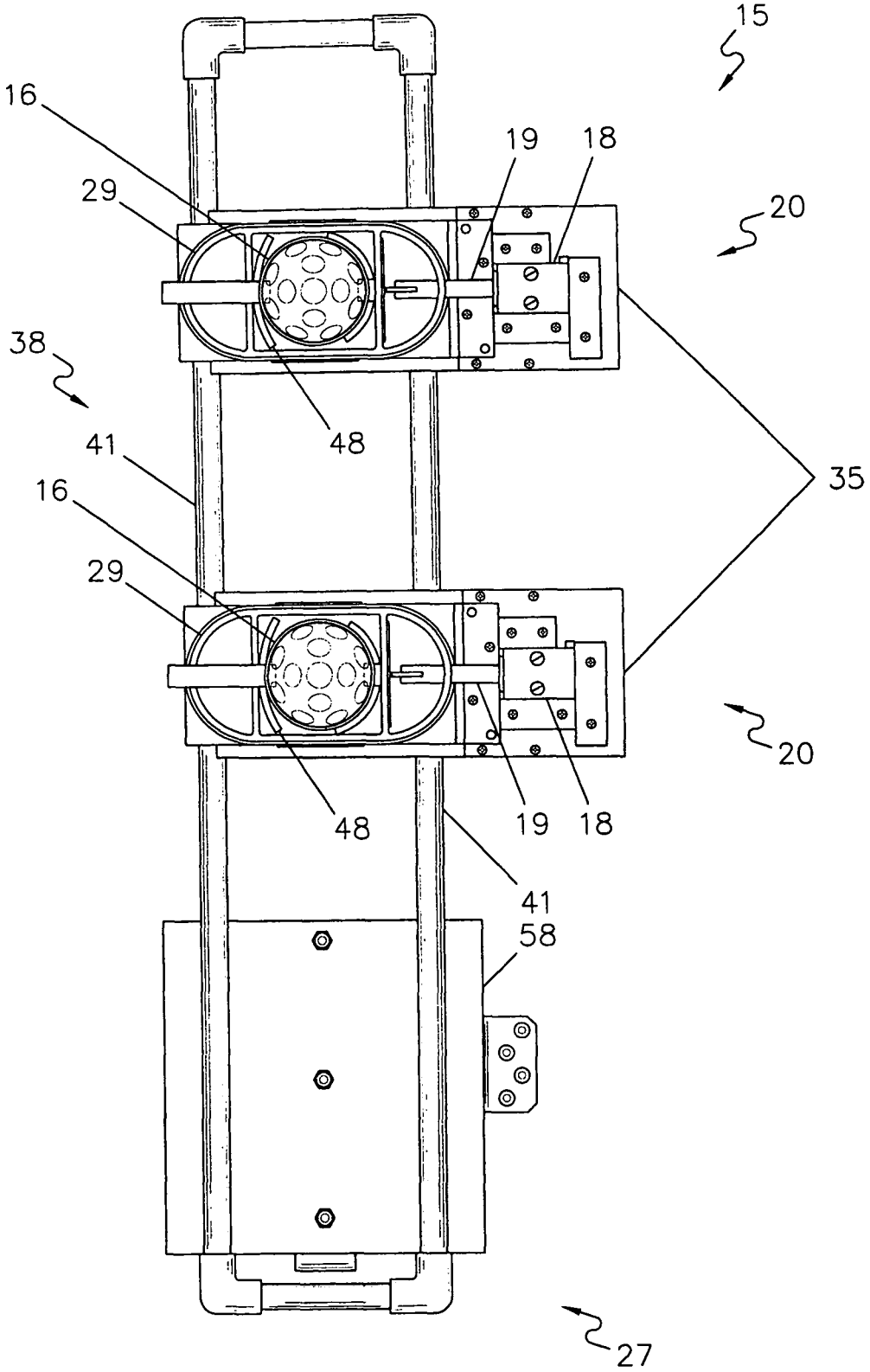
FIG. 3 is a top plan view of a ball release apparatus of the batting practice assembly of FIG. 2.

Referring to FIGS. 1 through 3, a batting practice assembly 10 includes: (a) a frame assembly 11 comprising a substantially vertical, height adjustable pole assembly 13 and a substantially horizontal ball release arm portion 27; (b) a ball release apparatus 15 supported on the ball release arm portion 27; (c) an electronic controller-power system 12 in communication with the ball release apparatus 15, the controller-power system 12 being powered by a power source; and (d) a separate foot-activated mechanism 17 in communication with the controller-power system 12. The ball release apparatus 15 includes at least one ball drop mechanism 20, most preferably two, each including a ball chute 16. Activation of the foot-activated mechanism 17 activates the ball release apparatus 15, which opens up the bottom ball chute hole 57. A lowermost practice ball 21 in one of the ball chutes 16 is thus released.

The foot-activated mechanism 17 is preferably placed on the ground flush with a section of indoor/outdoor carpeting 51, or on any other area of flooring or ground on which a stand base 24 of the frame assembly 11 rests. The bottom pole 26 of the pole assembly 13 is inserted in the stand base 24, which is preferably weighted. Depression of the foot-activated mechanism 17 activates the ball drop mechanism 20 so that the lowermost practice ball 21 that has been loaded in the ball chute 16 is released from the bottom of the activated ball chute 16. A batter standing in a ready stance next to the batting practice assembly 10 observes the practice ball 21 falling out of the ball drop mechanism 20 and chooses to swing at the ball 21 with a bat or the like, or not. Alternatively, in certain modes, no ball drops out of the ball chute, which also tests the batter's control. The controller-power system 12 is in connection with the ball drop mechanism 20, preferably via electrical wires.

Where the practice assembly 10 has two ball drop mechanisms 20, the batter does not know whether the next ball 21 will be released from the first or second ball drop mechanism 20, or when it will be released. This variability enhances the training value of the practice assembly 10. Since most children are beginners, a practice assembly 10 for a child need only include one of the ball drop mechanisms 20. Its versatility enables the variable mode batting practice assembly 10 to grow with the player. Since the practice assembly 10 is portable, it can be moved from one outdoor or indoor location to another.

The variable mode batting practice assembly 10 includes the following features, among others.

1. At least one ball drop mechanism 20, preferably two. Each ball drop mechanism includes a substantially vertical ball chute 16. The distance between the two ball chutes 16 is adjustable, preferably by sliding the ball drop mechanisms 20 toward one another on slide bars 41 of the ball release arm portion 27.

3. The ball drop is activated by the batter's front foot putting pressure on the foot-activated mechanism 17 as the batter's heel is planted to initiate the swing of the bat.

4. The height of the ball drop mechanisms 20 with their ball chutes 16 from ground level is adjustable. The user is thus able to increase or decrease available time to get the bat head to the ball.

5. The ball chutes 16 are adjustable so that an "inside pitch" is further "out front" than an "outside" pitch. Adjustment is by rotation of the upper pole 28, hence the ball release arm portion 27, in the lower pole 26. This is beneficial because the ideal contact points for inside and outside pitches are different and swing mechanics must vary accordingly.

6. There are several basic modes of operation of the practice assembly 10, which progress in difficulty from relatively easy to very difficult.

As depicted in the basic diagrams of FIGS. 11 and 12, four basic modes of operation of the practice assembly 10, from simplest to most difficult, are as follows.

Mode I—Ball 21 drops from one ball chute 16.

Figure 11:
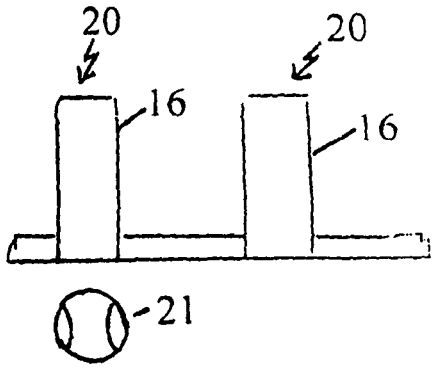
FIG. 11 is a diagram of two modes of a batting practice assembly according to the present invention.
Figure 11:
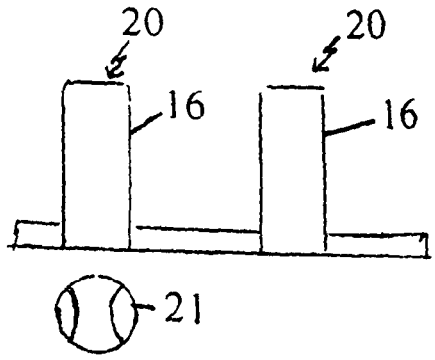
Figure 11:
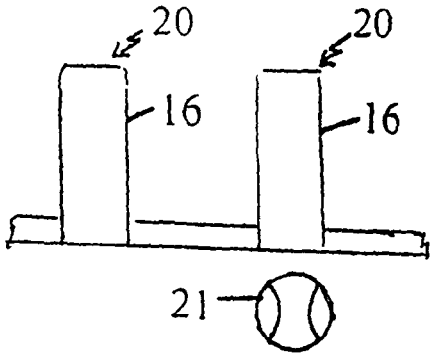

Mode II—Ball 21 drops randomly from either ball chute 16 (FIG. 11)

Mode III—Ball 21 drops randomly from either ball chute 16, or no ball is dropped at all.

Figure 12:
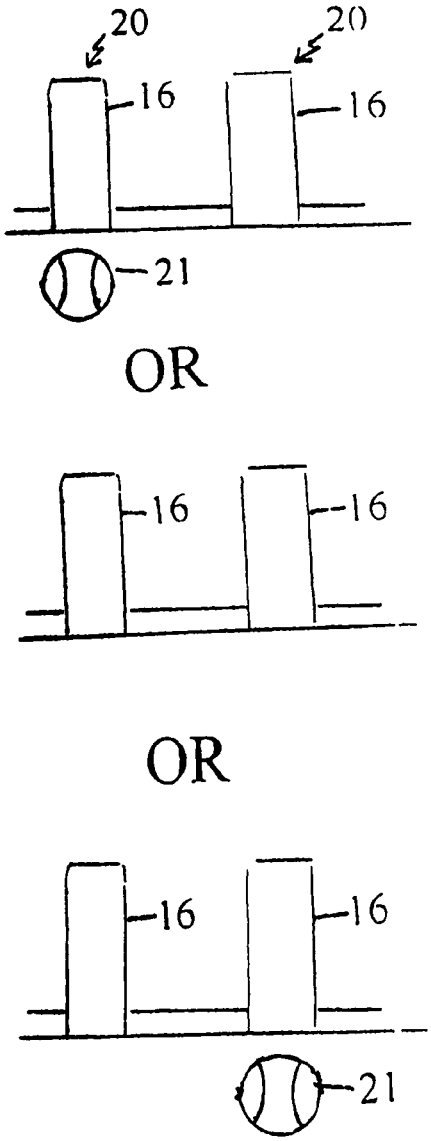
FIG. 12 is a diagram of two modes of a batting practice assembly according to the present invention.
Figure 12:
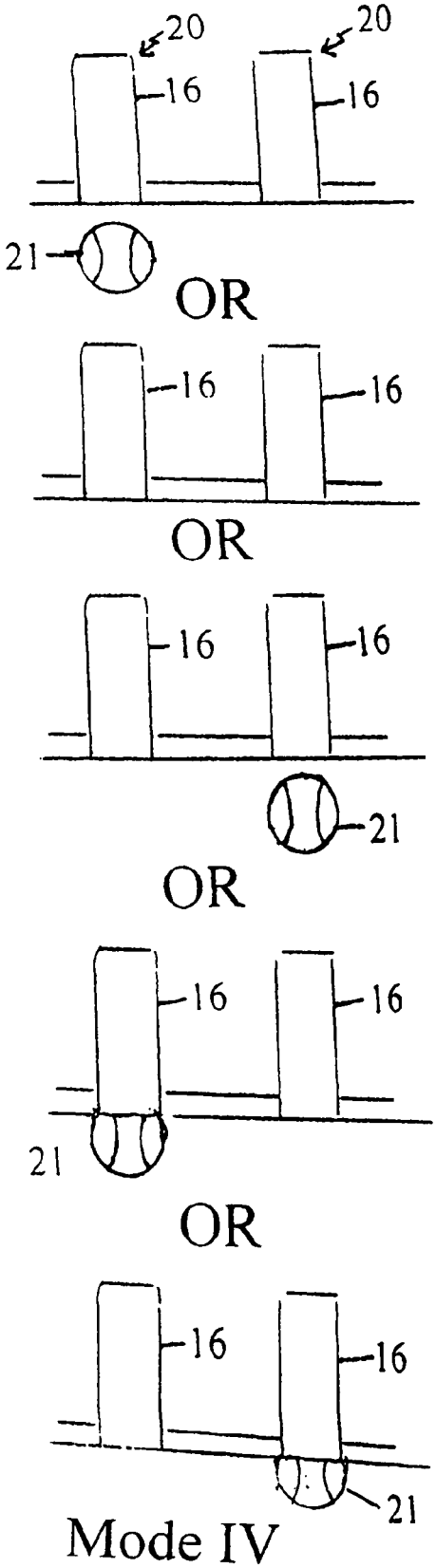

Mode IV—Random ball 21 drops from either ball chute 16, no ball drops, or ball 21 drops with a slight delay from either ball chute 16 (see FIG. 12).

When the practice assembly 10 is in Mode I, the ball falling from the ball chute 16 is relatively easy to hit. When the practice assembly 10 is in Mode IV, the falling ball is difficult to hit. In all modes, the level of difficulty can be altered by changing the distance between the ball chutes 16, the height of the ball chutes 16 from ground level, and/or the angle of the ball chutes 16 in relation to the hitter. Along with hitting mechanics, the decision-making aspects of hitting and in-swing adjustments to get the bat to the ball are developed through consistent practice with the present assembly 10. The practice ball 21 may be a baseball, whiffle ball, dimple ball, or any other suitable ball that a sports player strikes at with a bat (not shown), stick, or the like.

As seen in FIGS. 1 and 2, the adjustable frame assembly 11 of the practice assembly 10 includes: (1) the stand base 24, which is preferably weighted; (2) the height adjustable pole assembly 13; and (3) the ball release arm portion 27 at the upper end of the pole assembly 13. The substantially horizontal ball release arm portion 27 is substantially perpendicular to the substantially vertical pole assembly 13. The pole assembly 13 preferably includes: (a) a substantially vertical upper pole 28 with a lower end portion that is closely insertable in the hollow upper end portion 52 of (b) a substantially vertical lower pole 26 of the pole assembly 13; and (c) a pole height adjustment mechanism 14. The inside diameter of the hollow lower end portion of the lower pole 26 is preferably greater than the outside diameter (OD) of the upper end portion of the upper pole 28.

The pole height adjustment mechanism 14 preferably includes a pin 31 that is inserted through a hole 32 in the upper pole 28, as seen in FIG. 1. The upper pole 28 includes a number of upper pole holes 32 aligned in a substantially vertical row. An end of the pole pin 31 is preferably leashed to the pole assembly 13 so that the pole pin is less likely to be lost. The pole pin 31 maintains the upper pole 28 and the ball release arm portion 27 at the set height. The pole pin 31 is inserted in a lower one of the upper pole holes 32 if a taller pole assembly is desired, and in one of the higher pole holes 32 if a shorter pole assembly is desired. Generally speaking, the pole pin will be set higher for taller players, and lower for shorter players and children. However, more experienced or better players will likely prefer that the pole pin 31 be set in an upper one of the upper pole holes 32, so that the pole assembly 13 is shorter and the ball release apparatus 15 is lower. With a shorter pole assembly 13 (within the batter's swing range), the batter has less time to consider how to hit the ball 21 once it drops from the ball chute 16. A relatively tall pole assembly permits the player more time to swing, and is therefore generally preferred by less experienced, or beginner, players.

Figure 4:
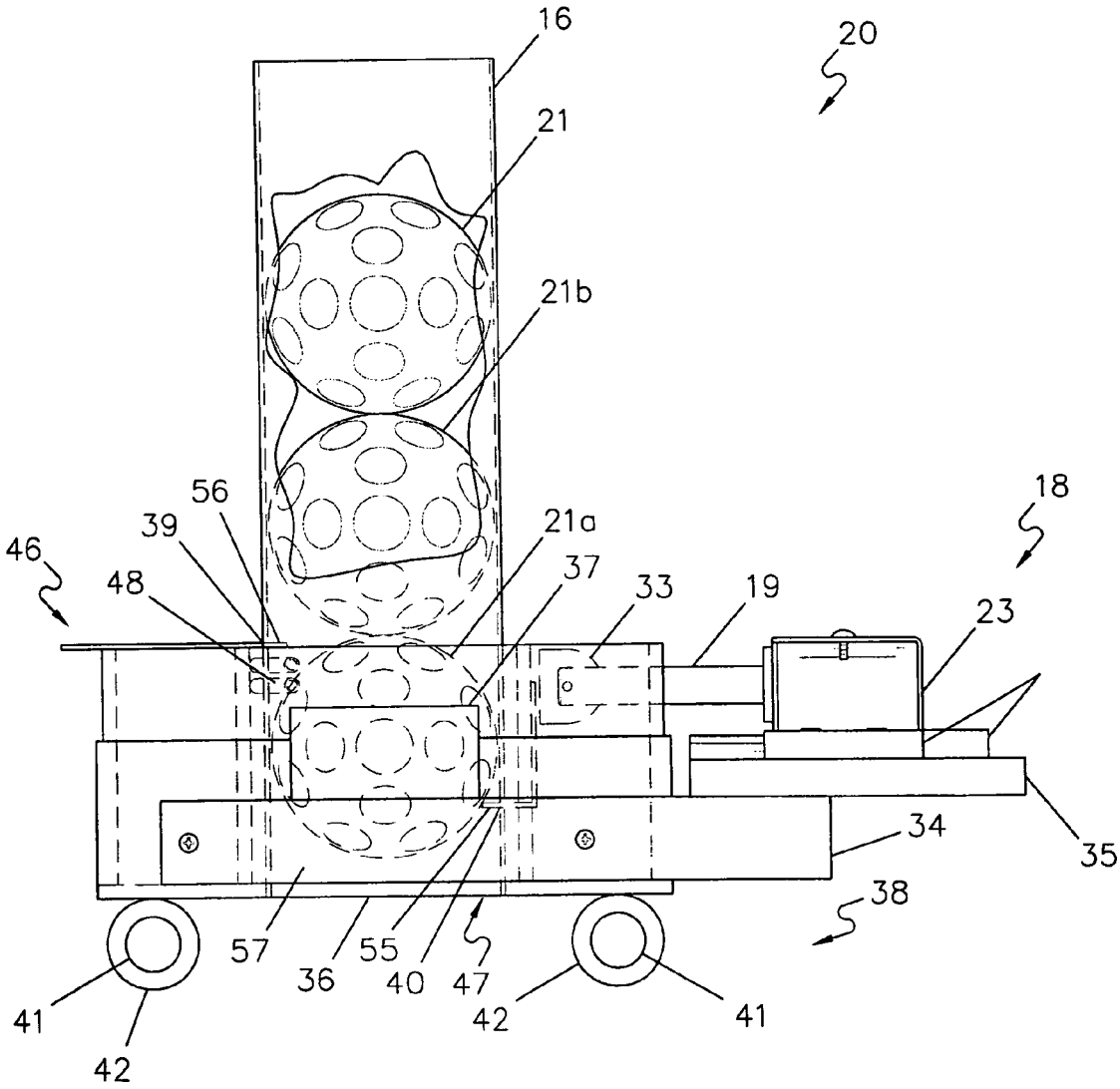
FIG. 4 is a side elevational view of one ball drop mechanism of the ball release apparatus of FIG. 3.

As seen in FIGS. 1, 3, and 4, the ball release apparatus 15 includes at least one ball drop mechanism 20, preferably two, and a slide bar assembly 38. Each ball drop mechanism 20 includes: (1) a substantially vertical ball chute 16; (2) at least one ball catch arm 46, 47 adjacent the ball chute 16; (3) a catch arm mechanism 25 in communication with the first ball catch arm 47; (4) an upper ball unit 29, which is slideable on (5) a lower ball unit 30; and (6) a moveable ball chute platform 34 beneath the lower ball unit 30. The first, lower catch arm 47 is below and on an opposite side of the ball chute 16 from the second, upper catch arm 46 (see FIGS. 4, 5, and 8).

In regard to the first of these, the outside diameter of the practice ball is slightly smaller than the diameter of the substantially cylindrical ball chute 16, so that the balls 21 fit in the chute. The practice balls 21 are stacked vertically on top of one another in the ball chute 16, as seen in FIG. 4. Each ball chute 16 is preferably pre-loaded with from one to about six balls 21 at a time. The length of the ball chute 16 determines the number of balls 21 that can be loaded into the practice assembly 10. The practice assembly 10 works even for smaller diameter practice balls 21 that do not fit closely in the ball chute 16.

Figure 5:
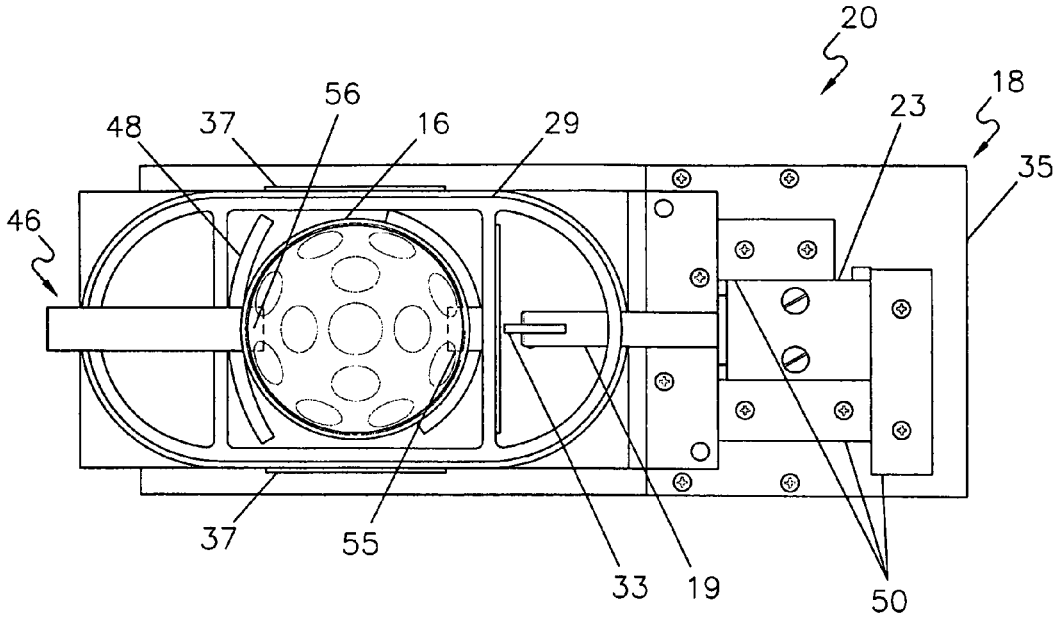
FIG. 5 is a top plan view of the ball drop mechanism of FIG. 4.

Continuing with FIGS. 4 and 5, at least one ball chute 16, and preferably only one, is affixed to each ball drop mechanism 20. The ball chute 16 is secured within an opening 36 in the ball chute platform 34. The open lower end of each cylindrical ball chute 16 fits securely in the substantially circular ball chute platform opening 36. The diameter of the ball chute platform opening 36 is slightly larger than the outside diameter of the ball chute hole 57. Once the release mechanism is triggered, the lowermost ball 21*a* in the ball chute 16 drops through the bottom ball chute hole 57 and the platform opening 36 (between the two parallel legs of the slide bar 41) and falls free.

In regard to the first catch arm 47 as seen in FIGS. 2-5, and 8, the first catch arm 47 is in communication with the catch arm "catch and release" mechanism 25. The upper end of the lower catch arm 47 is attached to the upper ball unit 29, so that the lower catch arm 47 extends down from the upper ball unit 29. The lower, substantially horizontal end portion 55 of the L-shaped first, lower catch arm 47 is movable into and out of a lower slot 40 in the ball chute 16 using the catch arm mechanism 25 (see FIGS. 2 and 4). The catch arm mechanism 25, which is activated by the foot-activated mechanism 17, causes the first catch arm 47 to move between a "catch" position and a "release" position. In the catch position (see FIG. 4), the lower, horizontal end portion 55 of the first catch arm 47 intrudes through the lower ball chute slot 40 into the interior of the ball chute 16, so that the lower, horizontal end portion 55 of the first catch arm 47 blocks the lowermost ball 21*a* and holds it and any balls 21 on top of it inside the ball chute 16 (see FIGS. 4 and 5). In the release position, the first catch arm 47 is moved away from the lowermost ball 21*a* and from the interior of the ball chute, allowing the practice ball 21*a* to fall out of the bottom ball chute hole 57 by gravity. The distance between the interior-facing end 56 of the second catch arm 46 and the horizontal end portion 55 of the first, lower catch arm 47 is preferably about equal to the diameter of a practice ball 21.

In regard to the second catch arm 46 as seen in FIGS. 1 and 4, each ball chute 16 includes an upper slot 39 through which the upper, second catch arm 46 passes. An interior end 56 of the upper, second catch arm 46 extends partway into the interior of the ball chute 16 when it is in a catch position, as shown in FIGS. 4 and 5. The second catch arm 46 extends below and supports the second ball 21*b*, which is just above the lowermost ball 21*a* in the ball chute 16 when there are two or more balls in the ball chute 16 (see FIGS. 2 and 4). The second catch arm 46 in the catch position prevents any other balls 21 (second, third, etc.) in the ball chute from falling out as the lowermost ball 21*a* is released. Both catch arms 46, 47 are attached to the upper ball unit 29, so when the ball drop solenoid 18 moves the solenoid arm 19, both catch arms move into the desired functional position.

Figure 6:
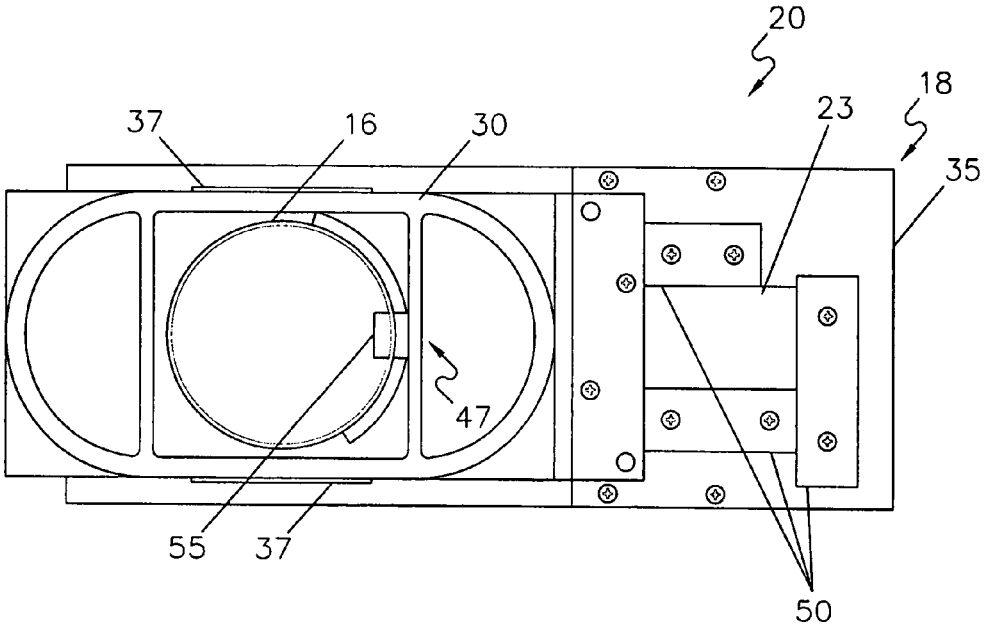
FIG. 6 is a top plan view of a lower ball unit of the ball drop mechanism of FIG. 4.

In regard to the ball units 29, 30 of each ball drop mechanism 20 as seen in FIGS. 4-6, the stationary lower ball unit 30 is under the moveable upper ball unit 29. The rigid lower ball unit 30 has a substantially smooth surface to reduce friction, and is preferably fabricated out of molded plastic or a similar material. Each lower ball unit 30 is attached to a moveable ball chute platform 34 of the ball drop mechanism 20, as seen in FIG. 4.

Continuing with FIGS. 3-6, the catch arm mechanism 25 preferably includes at least one solenoid switch 18 in communication with the movable upper ball unit 29 of each of the two ball drop mechanisms 20. In each ball drop mechanism 20, the solenoid frame 23 around the solenoid is securely attached to a solenoid switch platform 35, which is attached to, and extend beyond, the larger ball chute platform 34. The solenoid frame 23 is immobilized on the solenoid switch platform 35 by a raised solenoid stabilizer 50 (see FIG. 4).

Figure 7:
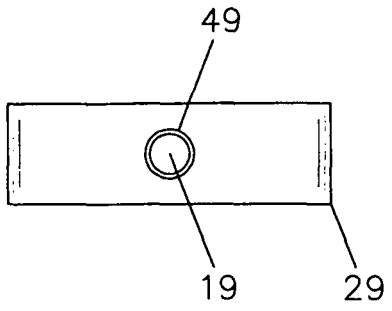
FIG. 7 is an end view of an upper unit of the ball drop mechanism of FIG. 5.
Figure 8:
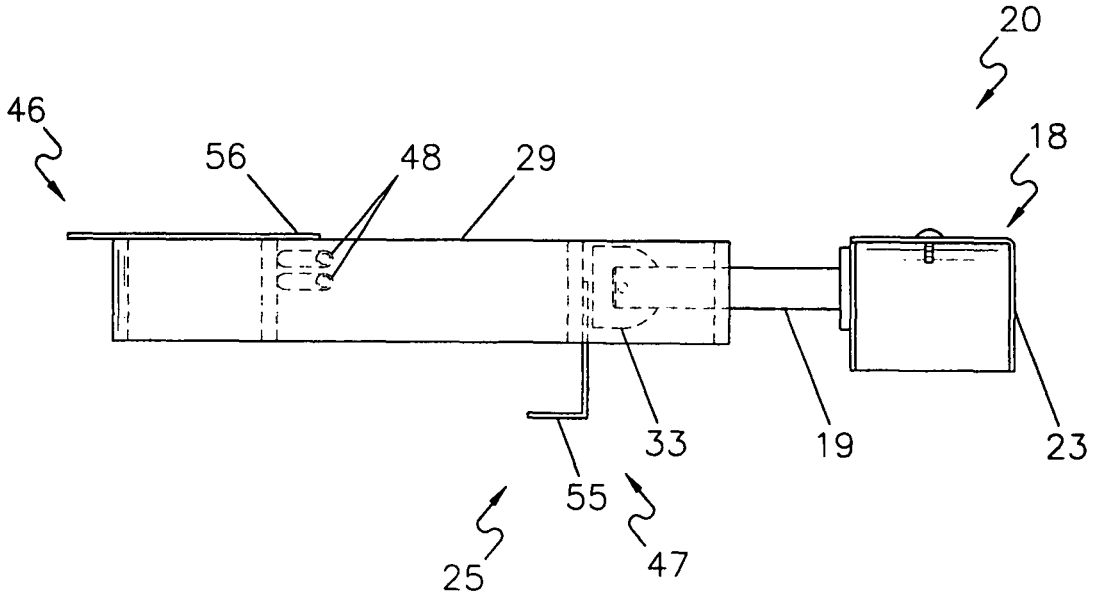
FIG. 8 is a side elevational view of the ball drop mechanism of FIG. 5.

The solenoid switch platform 35 is adjacent the lower ball unit 30. As seen in FIGS. 5, 7, and 8, the moveable solenoid arm 19 extends from the solenoid switch through a solenoid arm hole 49 in the end of the upper ball unit 29. A solenoid arm strike plate, or stop, 33 (in FIG. 5 and outlined in FIG. 8)

at the interior-facing end of the solenoid arm 19 strikes the side of the lower ball unit 30 when the solenoid arm 19 moves toward the solenoid frame 23.

When the foot-activated mechanism 17 is activated, the solenoid switch 18 is activated. The solenoid arm 19 is then pulled into the solenoid frame 23 of the solenoid switch 18. This causes the strike plate 33 to engage the inside wall of the upper ball unit 29, and pulls the moveable upper ball unit 29 along the top of the lower ball unit 30 toward the stabilized solenoid frame 23. As the upper ball unit 29 slides along the top of the lower ball unit 30, the horizontal end portion 55 of the first, lower ball catch arm 47 is withdrawn through the lower slot 40 in the ball chute 16. If one or more balls 21 have been loaded in the ball chute 16, moving the first, lower catch arm 47 away from its position beneath the lowermost ball 21*a* in the ball chute 16 allows the lowermost ball 21*a* to fall out (by gravity). At the same time, the upper ball catch arm 46 enters the ball chute 16 through the upper slot 39, which is on the opposite side of the ball chute 16 from the lower ball chute slot 40. The interior end 56 of the upper ball catch arm 46 prevents the second ball 21*b* in the ball chute 16 from dropping when the first, lowermost ball 21*a* falls out.

Once the solenoid switch 18 is deactivated, a tubular spring 48, or several springs such as two adjacent rubber tubes, bring the upper ball unit 29 back to its original position (see FIG. 8). This allows the second ball to drop and rest on the first, lower catch arm 47. This ball, now the lowermost ball 21*a*, will remain in position until that ball chute 16 is activated again.

The slide bar assembly 38 of the ball release apparatus 15 includes a set of slide bars 41, and slide rings 42, or any other suitable runners, that slide independently on the slide bars 41, as seen in FIGS. 1-3. The slide bars 41 are attached to a slide bar platform 58 of the ball release arm portion 27. The slide bar platform 58 rests on and is attached to the top of the smaller diameter upper pole 28, as depicted in FIGS. 1 and 2. Each slide bar 41 passes through a slide ring 42 beneath the lower ball unit 30. The bottom of each ball drop mechanism 20 is attached to two slide rings 42, so the ball drop mechanisms 20 are slideable along the slide bars 41. Preferably, one slide bar 41 extends under one end of each ball drop mechanism 20, and a parallel slide bar 41 extends under the other end of each ball drop mechanism 20. Each ball drop mechanism 20 with its solenoid switch 18 rests on two slide rings 42, so each ball drop mechanism 20 can be independently adjusted toward or away from the other ball drop mechanism 20 by sliding them along the slide bars 41 (see FIG. 1). Wires are connected from power connector jacks 59 on the slide bar platform 58 to the controller 54.

A thin, generally rectangular-shaped, plastic or metal guide plate 37 is attached on each side of the lower ball unit 30, as depicted in FIGS. 4-6. On each ball drop unit 20, these two guide plates 37 extend up above the level of the top of the lower ball unit 30 adjacent the sides of the upper ball unit 29. The guide plates 37 help to maintain the upper ball unit 29 in position as it slides generally horizontally along the top of the lower ball unit 30.

Figure 9:
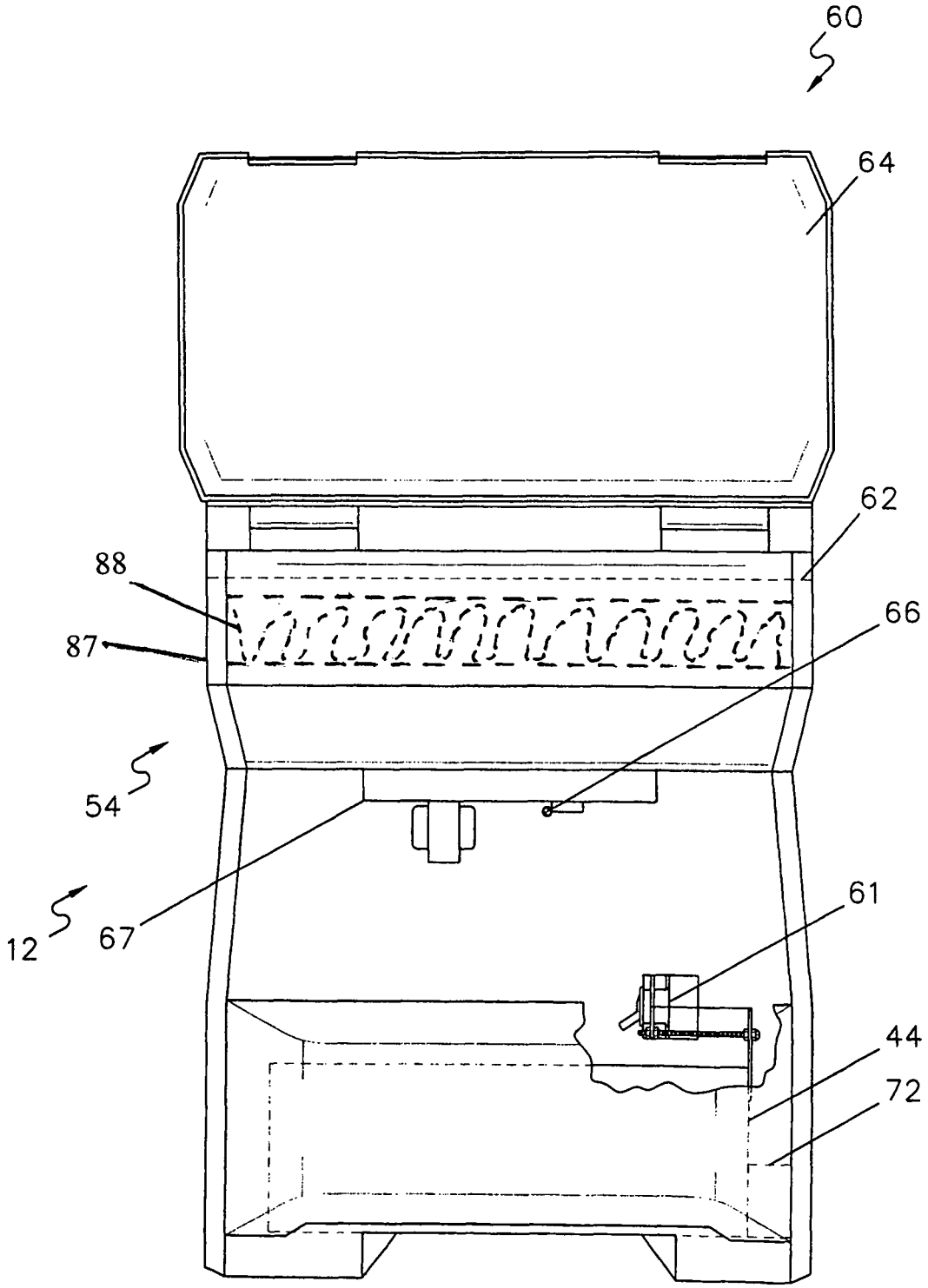
FIG. 9 is a top plan view of an open control cabinet and a foot switch of a batting practice assembly according to the present invention.

In the preferred practice assembly 10 shown in FIG. 1, the controller-power system 12, which includes the controller electronics and power supply, is housed in a control cabinet 60, where it is compact and out of the way. The power supply is preferably two batteries 44. The control cabinet 60 preferably rests on top of the stand base 24 (see FIG. 1), although it may rest on the ground near the rest of the practice assembly 10 (FIG. 2). On the stand base 24, the controller cabinet 60 is out of the way and weights the stand base 24 to discourage it from tipping over. The control cabinet 60 is preferably wheeled for easy transport. In addition to opposite wheels 63, the control cabinet 60 includes a cabinet lid 64 with a cabinet handle 65 on top as seen in FIG. 2 to facilitate movement of the control cabinet 60. In addition to the batteries 44, battery charger 72, and controller 54 circuitry, the control cabinet 60 holds the control panel 62, a mounting board 67, an on/off switch 61, and an off/off LED (light emitting diode) indicator light 66 as seen in FIG. 9. Just prior to using it, the user opens the controller cabinet 60 and flips on the on/off switch 61, or switches, to start the practice assembly 10. The lit LED light 66 in the cabinet 60 lets the user know that the unit is on.

As seen in FIG. 1, the batting practice assembly 10 is preferably powered by two batteries 44 in the controller-power system 12. A battery charger 72 is preferably also included. The batting practice assembly 10 can alternatively be powered by household electrical current. The batting practice assembly 10 is hard wired and/or includes a microprocessor. The batteries 44 are preferably a 12V battery and a 10 AH lead-acid battery, which, along with an associated dual battery charger 72, are installed in the control cabinet 60 for control and logic power. Preferably, one of the batteries 44 is used for powering the logic circuit and function generation modules, and the other battery is used to power the two ball drop solenoids.

The foot-activated mechanism 17 includes the foot-depressible plate 45, as seen in FIGS. 1 and 9, and associated electronics. The foot-activated mechanism 17 is activated by the pressure of the batter's foot on the foot-depressible plate 45, which is placed near the frame assembly 11 as seen in FIG. 1. In order to adapt to swing mechanics, which do not utilize an actual stride but rather a lifting and replanting of the batter's front heel during weight shift, there is no activation on initial pressure on the foot-depressible plate 45. Importantly, a time delay in the present assembly 10 allows activation of the ball drop mechanism 20 to occur, if desired, when the batter's heel replants during forward weight shift. Once it has been activated by initial foot pressure, the foot-activated mechanism 17 is only deactivated for a brief time, most preferably for about five seconds. This brief delay is advantageous in that it prevents a second ball drop by unintended foot pressure on the foot-depressible plate 45. Thus, the foot-activated mechanism 17 preferably includes a timer with about a one to ten second, most preferably about five seconds, delay period.

The batting practice assembly 10 is set up for maximum control of randomness of events in Modes II, III, and IV (see FIGS. 11 and 12). The probability of a specific event occurring can be set between about 20% and 80%, for example. (The total probability percentages of all event possibilities equals 100%.) Also, the "delay in drop" feature can be set at a preferred range of between about 0.04 second and about 0.50 second. The Mode (II-IV) is preferably selected by the batter using a selector, such as a dial or any other suitable control, on a control panel 62 in a cabinet 60 that houses the controller-power system 12.

Thus, in regard to the catch arm mechanism 25, an end portion 55 of the first ball catch arm 47 extends through the lower slot 40 in the ball chute 16 and is moveable beneath the lowermost ball 21*a* in the ball chute 16 (catch position) when the solenoid switch 18 is activated. When the first, lower ball catch arm 47 is moved away from the lower arm catch position beneath the ball 21*a* to the lower arm release position away from the ball 21*a* and the ball chute 16, the ball 21*a* drops out of the ball chute 16. When the solenoid switch 18 is deactivated, at least one tubular spring 48 in the upper ball unit 29 adjacent the side of the ball chute 16 that is opposite the solenoid switch 18 returns the upper ball unit 29 to a steady state position in line with the lower ball unit 30, causing the second ball 21 in the ball chute 16 to drop and rest on the end portion 55 of the first, lower catch arm 47.

When the second, upper catch arm 46 is in the upper arm catch position, the end 56 of the second catch arm 46 extends into the second, upper ball chute slot 39 into the ball chute 16. In this upper catch arm catch position, the interior end 56 of the upper catch arm 46 extends under the second ball in the ball chute 16, supporting the second ball 21*b* above the first, lowermost ball 21*a* in the ball chute 16.

It can be seen, then, that: (1) the distance between the ball chutes 16 is adjustable using the slide bar assembly 38; (2) the height of the ball chutes 16 is adjustable using the pole height adjustment mechanism 14; and/or (3) the angle of the ball chutes 16 in relation to the hitter is adjustable by moving the ball release arm portion 27 substantially horizontally to the desired position. These adjustments permit the user to select the level of difficulty provided by the practice assembly 10 just before, or during, a training session.

In regard to (1), the two ball chutes 16 can be pushed further together or farther apart on the slide bar 41. The closer the ball chutes 16 are together, the easier it is to get the bat to the ball, since the batter need not move his/her hands or body as much. Pulling the ball chutes 16 farther apart (within the constraints of the slide bar) increases difficulty; greater body adjustments are needed in order to hit the ball.

In regard to (2) above, the ball release arm portion 27 is moved up or down by pulling the lower end portion of the upper pole 28 up from inside the upper end portion 52 of the lower pole 26 (without pulling the poles apart). Alternatively, the user pulls the pole pin and allows the lower end of the upper pole 28 to descend into the hollow upper end portion 52 of the lower pole 26. The upper pole 28 is then fixed in place using the pole height adjustment mechanism 14. Decreasing pole height generally increases difficulty by giving the batter less time to make decisions and to swing. Conversely, increasing pole height generally gives the batter more time to make decisions and to swing.

In regard to (3) above, the angle of the substantially horizontal ball release arm portion 27 in relation to the substantially vertical pole assembly 13 is preferably adjustable. The ball release arm portion 27 can be moved horizontally along an approximate 180 degree arc around the upper pole 28 to the desired position. The upper pole 28 turns in the hollow end portion of the lower pole 27 to permit substantially horizontal movement of the ball release arm portion 27. As the ball release arm portion 27 is moved, the pole pin 31 in its corresponding upper pole hole 32 slides along the upper edge 53 of the lower pole 26. The angle is adjustable so that a ball 21 dropping from the ball chute 16 closest to the hitter is farther in front of the hitter than a ball 21 that drops from the more distant ball chute 16. This corresponds to what is generally considered an ideal contact point for hitting both inside pitches and outside pitches. Thus, the angle of the ball chutes 16 can be adjusted by twisting the upper pole 28 in the hollow upper end portion 52 of the lower pole 26. The ball chutes 16 are adjustable so that an "inside pitch" is further "out front" than an "outside" pitch. This is beneficial because the ideal contact points for inside and outside pitches are different and swing mechanics must vary accordingly. When the inside pitch is farther out front, the hitter has to be quicker and carry the bat further.

A standard home plate-sized marking, or home plate, is preferably placed on the ground between the foot-activated mechanism 17 and the stand base 24, as seen in FIG. 1. The batter uses this "home plate" 22 to position himself/herself as if a game was being played. The batter swings over this home plate 22.

The batting practice assembly 10 can be used by right handed and left handed players. The height of the stand 11 is adjustable, and the practice assembly 10 can be used by children, preferably with a single ball drop chute, as well as adults.

Figure 10:
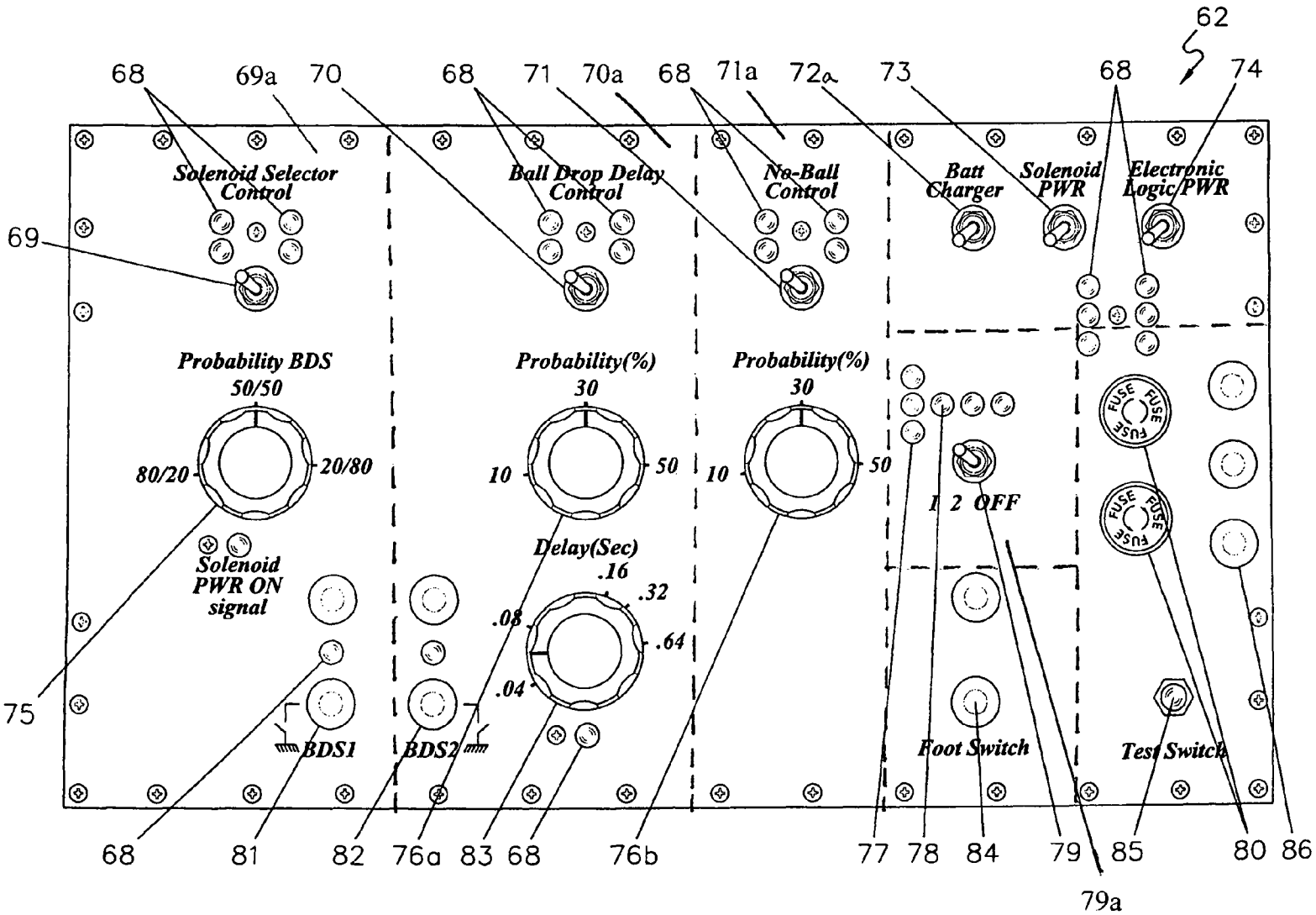
FIG. 10 is a perspective view of a control panel of a controller-power system according to the present invention.

Turning to FIGS. 9 and 10, the batteries 44, and controller 54 are housed in a control cabinet 60, or any suitable housing. The controller 54 includes several logic and function generation electronic modules. The modules include discrete electronic components of transistors, diodes, resistors, and capacitors. The various electronic modules are attached to a circuit board of the controller 54 inside the control cabinet 60. The various inputs and outputs are connected between the attached modules. A control panel 62 on the control cabinet 60 holds various switches, LED indicator lights 68, potentiometer control dials, power fuses 80, and connector jacks. The controls on the control panel can be dials, switches, or any other suitable type of controller.

The preferred ball release apparatus 15 includes two of the solenoid-operated ball chutes 16. A ball drop is initiated by the batter operating the foot-activated mechanism 17. Some batters want a ball 21 to be dropped when the foot switch mechanism is first closed. Others want the ball to drop on the second closure of the foot switch mechanism. Therefore, a Ball Drop Delay selector switch 70 on the control panel 62 provides at least two positions: a first position in which a ball drops on a first closure of the foot switch mechanism ("no delay"), and a second position in which a ball drops on a second closure of the foot switch mechanism ("delay").

The preferred control cabinet 60 incorporates logic circuitry that randomly selects which of the two solenoid-operated ball chutes 16 is used to drop a ball 21 to be batted when the batter operates the foot-depressible plate 45. A three-position selector switch 69 on the control panel 62 allows either ball chute 16 to always be selected, in addition to the normal mode of random chute selection. A Probability control dial 75 is also provided that allows the probability of Ball Chute #1 being selected versus the probability of Ball Chute #2 being selected to be varied over a range of 20% versus 80% to 50%/50% to 80%/20%.

Two other random functions are also provided herein. First, a random delay function is incorporated into the controller 54 to simulate the delay from an off-speed pitch (curve balls, changeups, etc.). The random delay function allows a randomly selected delay, adjustable by delay control dial 83, of 0.04 seconds to 0.64 seconds. These delay values are not intended to represent the optimum of any particular delay that may or may not result from the pitching techniques of any particular pitcher or from any particular pitching techniques. The probability of a delayed ball drop is controllable over a range of 10% to 50% by use of a probability control dial 76. As with the random ball chute selection feature, this random feature has a three-position ball drop delay switch 70, which allows the selection of always delaying the drop of the ball from a ball chute, or never delaying the drop of a ball from a ball chute, in addition to the normal selection of randomly delaying the drop of a ball (i.e., sometimes no delay, sometimes a delay).

A third random feature is incorporated into the ball drop controller to help motivate the batter to concentrate on his or her actions. This third random feature sets up a probability of about 10% to 50%, as designated by a probability control dial 76, that there will be no ball dropped at all by either ball chute. Through a three-position selector switch, selection can be made to always drop a ball, randomly not drop a ball, or never drop a ball. The controller 54 effectively goes in to a null mode when "never drop a ball" is selected. The first Probability dial 76*a* controls the probability of there being a delay in the ball drop. The second, right hand Probability dial 76*b* gives the percentage of time that no ball is dropped from either ball chute 16.

All three of the random features are implemented in the same way, as follows. Three square wave generators (preferably with respective frequencies of 6 Hertz, 31 Hertz, and 130 Hertz) constantly set and reset three associated simple set-reset flip-flops. When the foot switch mechanism 17 is closed, indicating that a ball 21 is to be dropped, then by way of logic gates, the three flip-flops are 'frozen' at the state that they are in at the instant that the foot switch mechanism is closed. Since there is no correlation between the instant in time that the foot switch mechanism is closed and the state of the three flip-flops, the state that the flip-flops are in when 'frozen' is a random event. For two of the random features, if the associated flip-flop is frozen in the 'set' state, the random event is selected to 'occur'. If frozen in the 'reset' state, the random event does not occur. For random selection between the two ball drop solenoids, the 'set' state causes selection of Solenoid 1, the 'reset' state causes selection of Solenoid 2. The probability of a flip-flop being in the 'set' state when 'frozen' is controlled by a potentiometer on each associated square wave generator that controls the relative time the flip-flop is in the 'set' state verses the relative time that the flip-flop is in the 'reset' state. For example, if a 10% probability of the occurrence of a random feature is desired, then the associated square wave generator is adjusted to maintain the associated flip-flop in the "set" state for only 1 unit of time for every 9 units of time the flip-flop is in the 'reset' state.

In regard to the functionality of each electronic module, or mechanisms, with module circuitry in the preferred ball drop controller, the practice assembly 10 may be operated by any suitable method of implementation. One suitable power supply is two lead-acid batteries rated 12 Volts and 10 AH to power the ball drop controller 54. A first one of the batteries 44 is used to power the electronic circuit modules. When this first battery is used, the power connection point on the module diagram is designated "+Vcc1". When the other, second battery is used to power the ball drop solenoids 18, the connection point on the circuit module is designated "+Vc2". The negative terminals of both batteries 44 are connected to the circuit ground in the control cabinet 60. For clarity of illustration, batteries, battery switches, battery fuses, battery status LEDs (such as low voltage indication), and the dual battery charger are not shown on the circuit module diagram (see FIG. 13).

Figure 13:
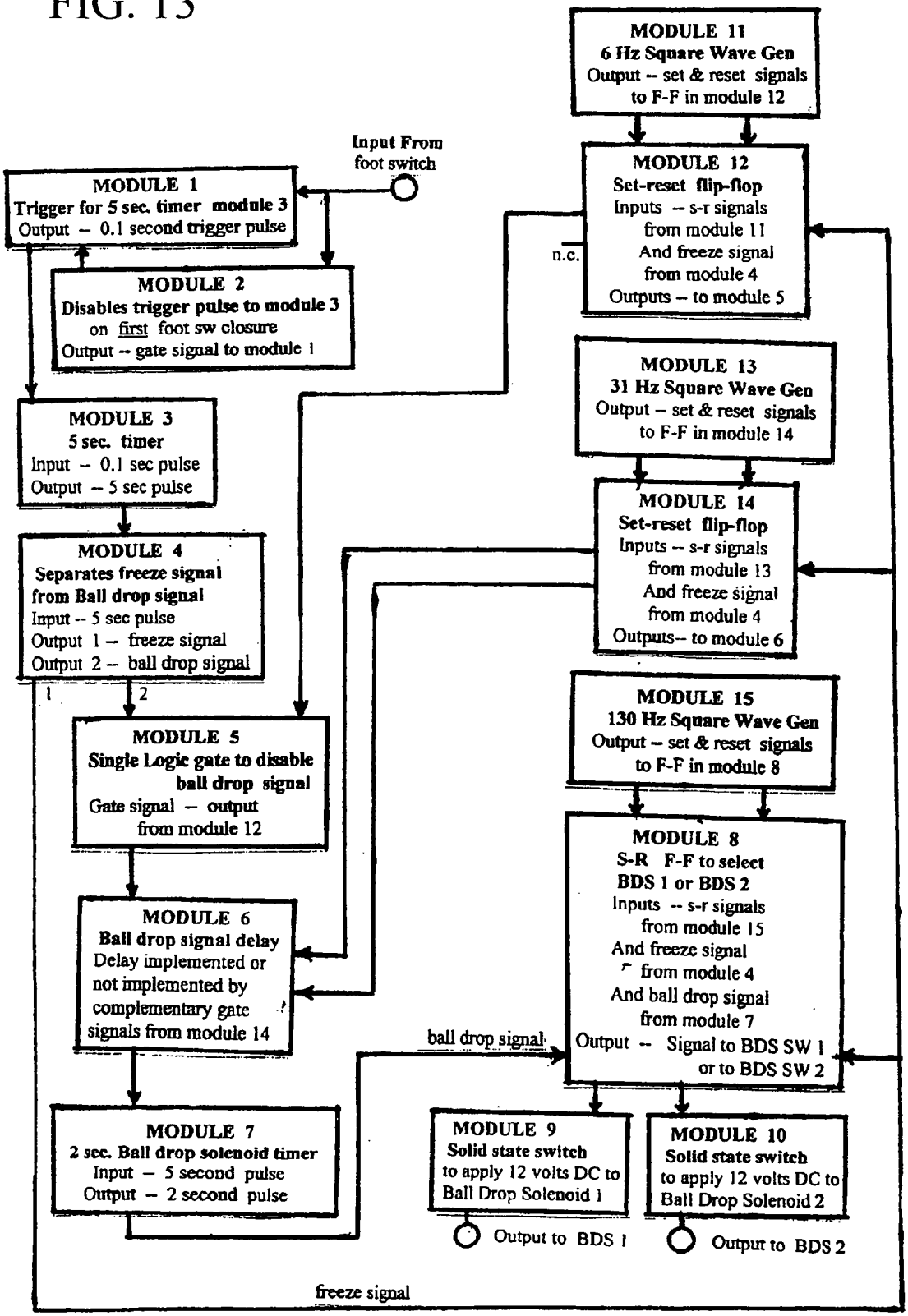
FIG. 13 is a flowchart of 15 modules of a batting practice assembly according to the present invention.

As depicted in FIG. 13, a preferred controller 54 herein includes 15 major controller modules, or functions, each of which is discussed below. The controller 54 is preferably housed in the control cabinet 60 with the control panel 62. The control panel 62 is preferably at the top of the control cabinet 60 interior, so the controls are easily accessed once the cabinet lid 64 is opened. One or more indicator LEDs (Light Emitting Diodes) 68 on the control panel 62 give the control operator some assurance that each of the modules is operating as expected. The control operator may be the batter, batter's coach, or any other assistant.

MODULE 1 The foot-depressible plate 45 is connected to Module 1 by way of foot switch banana jacks 84 on the control panel 62. A test switch button 85 adjacent the foot switch jacks 84 is also provided on the control panel 62. When the foot switch mechanism is closed, a 0.10 second timed pulse is initiated. The 0.10 second timed pulse is a trigger pulse to Module 3, which is a five second timer that controls the remainder of the operation of the preferred controller 54. Other, different amounts of times could alternatively be used.

MODULE 2 Module 2 is connected only to Module 1. Module 2 is used to gate the output of Module 1 in such a way that the five second timer of Module 3 is triggered by the second closure of the foot switch mechanism after the foot switch mechanism has been reopened for a period of not more than three seconds. Thus, the five second timer of Module 3 is not triggered when the foot switch mechanism is first closed. Module 2 has a three-position 1 2 OFF selector switch 79. The first position of the 1 2 OFF switch 79 disables Module 2 and allows Module 1 to trigger the five second timer of Module 3 on the first foot switch closure. In the second switch position, Module 2 is allowed to function as intended and the five second timer of Module 3 is triggered by Module 1 upon the second closure of the foot switch mechanism. The third position of the switch 79 disables Module 2 in such a way that Module 1 is also disabled, thus disabling all functions of the ball drop controller 54.

MODULE 3 Module 3 is a five second timer initiated by pressure of the batter's foot by way of Module 1 and Module 2, as described above. During the five second period, the foot switch mechanism is effectively disabled, since its operation is not relevant. For the five second period, all other random and or selected functions of the ball drop controller are initiated and performed. At the end of the five second period, all functions of the controller are reset, including foot switch operation, and the controller 54 is ready to drop another ball 21 upon operation of the foot-depressible plate 45 by the batter. The five second output pulse of Module 3 is inputted directly into Module 4. A longer or shorter output pulse could be utilized in place of a five second pulse.

MODULE 4 This module splits the five second timed signal pulse from Module 3 into two signals. The first of the two signals is a "freeze" signal that stops the three random processes at whatever state they are in when the Freeze signal first begins. The second of the two signals is the Ball Drop signal itself. The Freeze signal connects to Modules 12, 14, and 8. The reason for separating the Ball Drop signal from the Freeze signal is to ensure that the set-reset-flip-flops in Modules 12, 14, and 8 have stabilized and stopped changing states, and are not in a transition state, before the Ball Drop signal is applied to the logic gates that these flip-flops control. To ensure this action, the Freeze signal has no intentional delay, but the Ball Drop signal is delayed 0.001 second, thus allowing this amount of time for the flip-flops to stabilize.

MODULE 5 Module 5 is a simple gate that the Ball Drop signal from Module 4 passes through when the associated random feature flip-flop (Module 12) is in the 'reset' state. If the associated flip-flop is in the 'set' state, the simple gate prevents the Ball Drop signal from going any further and no ball is dropped from solenoid 1 or solenoid 2 following closure of the foot switch mechanism.

MODULE 6 Module 6 implements the random delay feature discussed above. It contains two gated paths that the Ball Drop signal from Module 5 may flow through. The first path is selected if the associated flip-flop is frozen in the 'reset' state. It contains a simple pass through of the Ball Drop signal with no intentional delay. The second path inserts a calibrated delay of 0.04 to 0.64 second when the associated flip-flop is frozen in the 'set' state. The amount of delay is user-selected by use of a potentiometer mounted on the control panel 62, which is attached to Module 6.

MODULE 7 This module allows only the first two seconds of the five second Ball Drop signal to pass through to the logic gates in Module 8. After two seconds, the output of Module 7 is gated to '0'. The primary purpose of Module 7 is to conserve battery power and reduce heating in the ball drop solenoids 18. A secondary purpose is to ensure that there is no miss-operation of the ball drop logic gates from transients when Module 3 resets the five second Ball Drop signal to '0'.

MODULE 8 This module contains the set-reset flip-flop associated with the random selection between Ball Drop Solenoid 1 and Ball Drop Solenoid 2 18. It also contains the logic gates associated with freezing the flip-flop upon the application of the Freeze signal from Module 4. Module 8 is the same as the other two flip-flop Modules 12 and 14, except that Module 8 also incorporates the logic gates that route the Ball Drop signal to Ball Drop Solenoid 1 when the flip-flop is frozen in the 'set' state, and to Ball Drop Solenoid 2 when the flip-flop is frozen in the 'reset' state. Module 8 has two outputs that connect directly to the two solid state switches that operate the two ball drop solenoids. In addition to the random mode, a three-position Solenoid Selector switch 69 allows forced selection of either Ball Drop Solenoid 1 or Ball Drop Solenoid 2.

MODULE 9 This module functions as a 7 ampere solid state switch that activates Ball Drop Solenoid 1. It closes upon grounding the input terminal by way of logic gates in Module 8.

MODULE 10 This module preferably functions as a 7 ampere solid state switch that activates Ball Drop Solenoid 2. It closes upon grounding the input terminal by way of logic gates in Module 8. Except for its input and output connections, Module 10 is the same as Module 9.

MODULE 11 This module contains a free running, astable multi-vibrator circuit configuration with no input except 12 volt power connections. It has 2 square wave outputs that provide set and reset signals to the flip-flop in module 12. It operates at a frequency of 6 Hz. The relative pulse widths of its complementary outputs are controllable by the user by way of a potentiometer mounted on the control panel 62 and connected to Module 11.

MODULE 12 This module contains a simple set-reset flip-flop that is continuously set and reset by two connections to Module 11. This module also contains the logic gates to 'freeze' the flip-flop upon the closure of the batter foot switch mechanism, thus resulting in the application of a Freeze signal from Module 4. Although Module 12 has complementary outputs, on the 'set' output is used and it is connected to the logic gate in Module 5 that aborts the dropping of a ball. Modules 11 and 12 implement the random feature of creating a user controllable probability that no ball will be dropped upon the closure of the foot switch mechanism by the batter. In addition to the random mode, a three-position No-ball Control switch 71 permits selection of "never dropping a ball" or "always dropping a ball".

MODULE 13 This module contains a free-running, astable multi-vibrator circuit configuration with no input except 12 volt power connections. It has 2 square wave outputs that provide set and reset signals to the flip-flop in Module 14. It operates at a frequency of 31 Hertz. The relative pulse widths of its complementary outputs are controllable by the user by way of a potentiometer mounted on the control panel 62 and connected to Module 13. Except for operating frequency controlled by related capacitors, this module is the same as Module 11.

MODULE 14 This module contains a simple set-reset flip-flop that is continuously set and reset by two connections to module 13. This module also contains the logic gates to 'freeze' the flip-flop upon the closure of the batter foot switch mechanism, thus resulting in the application of a Freeze signal from Module 4. Module 14 has complementary outputs. The 'set' output and the 'reset' output are connected to the logic gates in Module 6 that control whether the ball drop signal will pass through Module 6 delayed or not delayed. Modules 13 and 14 implement the random feature of creating a user-controllable probability that the ball drop will be delayed upon the closure of the foot switch mechanism by the batter. In addition to the random mode, a three-position ball drop delay user switch 70 allows selection of "never delay the ball drop" or "always delay the ball drop". Except for input and output connections, Module 14 is the same as Module 12.

MODULE 15 This module contains a free-running, astable multi-vibrator circuit configuration with no input except 12 volt power connections. It has two square wave outputs that provide set and reset signals to the flip-flop in Module 8. It operates at a frequency of 130 Hertz. The relative pulse widths of its complementary outputs are controllable by the user by way of a potentiometer mounted on the control panel and connected to Module 15. Except for operating frequency controlled by related capacitors, and the range of pulse width control resistors, this module is the same as Module 11 and Module 13.

Thus, a preferred control panel 62 as seen in FIG. 10 includes any or all of the following controls.

1) A three-position Solenoid Selector Control switch 69 has positions at: "BDS1", Ball Drop Solenoid 1, where the ball drops from Ball Chute #1 (which is usually closer to the hitter); "S1/random/S2", where ball drop is random; and "BDS2", Ball Drop Solenoid 2, where the ball drops from Ball Chute #2. LEDs 68 light up to indicate a selection.

A probability BDS1/BDS2 potentiometer control dial 75 below the Solenoid Selector Control switch 69 on the control panel 62 includes markings at 80/20 (to the left), 50/50 (middle), and 20/80 (right), although the probability BDS1/BDS2 dial 75 can also be set between markings (e.g., at 70/30). The probability BDS1/BDS2 dial 75 is used when the Solenoid Selector Control switch 69 is set on "random". For example, if the probability BDS1/BDS2 dial 75 is set at 80/20, then 80% of the time, the ball will come from Ball Chute #1, and 20% of the time, the ball will come from Ball Chute #2 in random fashion. Below the Solenoid Selector Control switch 69 and the probability BDS1/BDS2 dial 75 on the control panel 62 is an LED 68 that indicates a "Solenoid Power On signal".

Two BDS1 and two BDS2 connector jacks 81, 82 on the control panel 62 are used to connect wires from the first and second Ball Drop Solenoids, respectively. If desired, any other suitable means of connection can be used instead of connector jacks herein.

2) A three-position Ball Drop Delay Control switch 70 has settings for "no delay" (Mode I or II), "random", and "delay". Adjacent LEDs 68 on the control panel 62 light up to indicate a selection.

Once the Ball Drop Delay Control switch setting is chosen, the Probability dial 76*a* under the Ball Drop Delay Control switch 70 is used to select the percentage of times the hitter wants it to delay (e.g., 50% of the time) and the Delay time dial 83 is used to select the amount of time the hitter wants it to be delayed. The Probability (%) dials 76 each include markings at 10%, 30%, and 50%. The Delay time dial (in seconds) 83 has markings at 0.04, 0.08, 0.16, 0.32, and 0.64 second. If the Delay time dial 83 is set on 0.16 second, for example, there will be a 0.16 second delay between the time the foot-depressible plate is depressed and the time a signal is transmitted to the solenoid to drop the ball from the ball chute. An LED 68 below the Delay time dial 83 lights up when the dial is on.

3) A three-position No-ball Control switch 71 has settings for "ball", "random", and "no ball". For the "ball" setting, the ball 21 drops each time the foot-depressible plate 45 is depressed. The "no ball" setting, which is rarely chosen, deactivates both ball drop solenoid switches. LEDs 68 light up to indicate a selection. When the "random" setting on switch 71 is chosen, a selection is made on the second Probability dial 76*b* below the No-ball Control switch 71, which preferably has markings at 10%, 30%, or 50%. When the "random" setting of the switch 71 and "30%" on the dial 76*b* are chosen, for example, 30% of the time the foot-depressible plate 45 is depressed, no ball drops, while 70% of the time, a ball is dropped from a ball chute when the foot-depressible plate 45 is depressed.

4) An on/off Battery Charger switch 72*a* turns the battery charger 72 in the control cabinet 60 on and off.

5) An on/off Solenoid Power switch 73 adjacent the Battery Charger switch 72*a* on the control panel 62 is for turning the solenoid power on and off.

6) An Electronic Logic Power switch 74 has an on position and an off position.

7) A "1 2 OFF" switch 79 below the Battery Charger switch 72*a* on the control panel is of particular interest to the majority of hitters who take a stride as part of their swing. Position 1 of the 1 2 OFF (stride/no stride) switch 79 is selected by hitters who take a stride. Depression of the foot-depressible plate 45 triggers a ball drop.

Position 2 of the 1 2 OFF (stride/no stride) switch 79 is selected by hitters who prefer not to take a stride during a swing. Instead of taking a stride, they normally lift a heel and replant it, thus depressing the foot-depressible plate 45 a second time. In switch position 2 for non-striders, ball drop is delayed for a pre-set time period in order to allow time for the hitter's heel to be replanted. Activation of the ball drop is delayed for up to five seconds while the hitter replants the heel. If the hitter waits longer than five seconds, he must step off completely and start again. (Of course, the position numbers can be reversed, with position 1 for non-striders and position 2 for striders.)

In connection with the 1 2 OFF switch 79, "Select 5 second drop" LEDs light up during the five second deactivation period once the ball drop solenoid 18 is activated. The five second dead/deactivation period prevents an inadvertent touching of the foot-depressible plate 45 from unintentionally causing another ball drop.

Also in connection with the 1 2 OFF switch 79, "Armed 0.1 second Foot Switch" LEDs 78 adjacent the "select 5 second drop" LEDs 77 and the 1 2 OFF switch 79 indicate whether the 1 2 OFF switch is in the strider or non-strider position.

8) 1 amp and 5 amp power fuses 80 are included.

9) Wires to the foot-depressible plate are connected to two adjacent connector jacks 84 on the control panel 62.

10) A Test Switch button 85 on the control panel 62 can be depressed in place of depressing the foot-depressible plate 45, if desired. The Test Switch button 85 provides an alternative for wheelchair occupants or others who would rather have someone push a button rather than activate a foot-depressible plate 45 with a foot.

11) Three V(e) and V(s) power connector jacks 86 and adjacent LEDs 68 indicate voltage.

From the foregoing it can be realized that the described assembly of the present invention may be easily and conveniently utilized as a variable mode batting practice assembly. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 batting practice assembly
11 frame assembly
12 controller-power system
13 pole assembly
14 pole height adjustment mechanism
15 ball release apparatus
16 ball chute
17 foot-activated mechanism
18 ball drop solenoid
19 solenoid arm
20 ball drop mechanism
21 ball
22 home plate
23 solenoid frame
24 stand base
25 catch arm mechanism
26 lower pole
27 ball release arm portion
28 upper pole
29 upper ball unit
30 lower ball unit
31 pole pin
32 upper pole holes
33 solenoid arm strike plate
34 ball chute platform
35 solenoid switch platform
36 ball chute platform opening
37 upper unit guide plate
38 slide bar assembly
39 upper slot in ball chute
40 lower slot in ball chute
41 slide bar
42 slide ring
44 battery
45 foot-depressible plate
46 upper, second catch arm
47 first, lower catch arm
48 tubular springs
49 solenoid arm hole
50 solenoid stabilizer
51 carpeting
52 upper end portion of lower pole
53 upper edge of lower pole
54 controller
55 horizontal end portion of first catch arm
56 interior end of second catch arm
57 bottom ball chute hole
58 slide bar platform
59 power connector
60 control cabinet

61 unit on/off switch
62 control panel
63 cabinet wheels
64 cabinet lid
65 cabinet handle
66 on-off LED
67 mounting board
68 LEDs
69 solenoid selector switch
70 ball drop delay switch
71 no-ball control switch
72 battery charger switch
73 solenoid power switch
74 electronic logic power switch
75 probability BDS1/BDS2 dial
76 probability (%) dial
77 select 5 second drop LEDs
78 armed 0.1 second foot switch LEDs
79 1 2 OFF switch
80 fuses
81 BDS1 connector
82 BDS2 connector
83 Delay (seconds) dial
84 foot switch jacks
85 test switch button
86 V(e) and V(s)

What is claimed is:

1. A batting practice assembly, comprising:

(a) an adjustable frame assembly comprising a substantially horizontal ball release arm portion, and a height adjustable, substantially vertical pole assembly, the pole assembly being attached at its upper end portion to the ball release arm portion;

(b) a ball release apparatus supported on the ball release arm portion, the ball release apparatus comprising at least two ball drop mechanisms and a slide bar assembly, each ball drop mechanism comprising: at least one ball chute, at least one ball catch arm adjacent the ball chute, and a catch arm mechanism in communication with the at least one ball catch arm, each ball drop mechanism being slideable on a slide bar of the slide bar assembly;

(c) an electronic controller-power system in communication with the ball release apparatus, the controller-power system comprising a variable mode controller and a power supply; and (d) a separate foot-activated mechanism in communication with the controller; wherein activation of the foot-activated mechanism activates the catch arm mechanism, which opens a bottom ball chute hole in the at least one ball chute; wherein the ball release apparatus comprises a mechanism for randomly selecting one of a first of the at least two ball drop mechanisms, a second of the at least two ball drop mechanisms, or none at all; the slide bar allowing for independent sliding of the at least two ball drop mechanisms.

2. The batting practice assembly according to claim 1, wherein a first, lower one of the at least one ball catch arms is movable between a catch position and a release position using the catch arm mechanism, the catch arm mechanism being activated by the foot-activated mechanism.

3. A batting practice assembly, comprising: (a) an adjustable frame assembly comprising a substantially horizontal ball release arm portion, and a height adjustable, substantially vertical pole assembly, the pole assembly being attached at its upper end portion to the ball release arm portion; (b) a ball release apparatus supported on the ball release arm portion, the ball release apparatus comprising at least two ball drop mechanisms or at least two ball chutes and a slide bar assembly, each ball drop mechanism comprising: at least one ball chute, at least one ball catch arm adjacent the ball chute, and a catch arm mechanism in communication with the at least one ball catch arm, each ball drop mechanism being slideable on a slide bar of the slide bar assembly; (c) an electronic controller-power system in communication with the ball release apparatus, the controller-power system comprising a variable mode controller and a power supply; and (d) a separate foot-activated mechanism in communication with the controller; wherein activation of the foot-activated mechanism activates the catch arm mechanism, which opens a bottom ball chute hole in the at least two ball chutes; and further comprising at least the following four selectable modes: Mode I—a lowermost ball drops from a first one of the at least two ball chutes; Mode II—the lowermost ball drops randomly from either the first ball chute or a second one of the at least two ball chutes; Mode III—the lowermost ball drops randomly from either the first ball chute or the second ball chute, or no ball is dropped at all; and Mode IV—the lowermost ball randomly drops from either the first ball chute or the second ball chute, no ball drops, or the lowermost ball drops with a delay from either the first ball chute or the second ball chute.

4. The batting practice assembly according to claim 3, wherein the ball release arm portion supports the slide bar assembly and two of the at least two movable ball chutes, the ball drop mechanisms being independently moveable along the slide bar.

5. The batting practice assembly according to claim 3, wherein the adjustable pole assembly comprises a substantially vertical upper pole having a lower end portion that is closely insertable in a hollow upper end portion of a substantially vertical lower pole of the pole assembly, and a pole height adjustment mechanism; wherein the ball release arm portion is angle adjustable through rotation of the upper pole in the lower pole, and wherein the height of the bottom of the ball chutes from ground level is adjustable using the pole height adjustment mechanism.

6. The batting practice assembly according to claim 3, wherein the ball drop mechanism further comprises a second, upper catch arm, which in an upper arm catch position extends into a second, upper ball chute slot into the ball chute; and wherein an end portion of the second, upper catch arm in the upper catch arm catch position extends under a second ball in the ball chute, the second ball being above a first, lowermost ball in the ball chute.

7. The batting practice assembly according to claim 3, wherein the controller comprises a Ball Drop Delay Control switch module comprising a Ball Drop Delay Control switch on a control panel of the controller, the Ball Drop Delay Control switch comprising at least two positions: a first, "no delay" position in which the lower catch arm moves to the release position on a first closure of the foot-activated mechanism, and a second, "delay" position in which the lower catch arm moves to the release position on a second closure of the foot-activated mechanism.

8. A batting practice assembly, comprising: (a) an adjustable frame assembly comprising a substantially horizontal ball release arm portion, and a height adjustable, substantially vertical pole assembly, the pole assembly being attached at its upper end portion to the ball release arm portion; (b) a ball release apparatus supported on the ball release arm portion, the ball release apparatus comprising at least two ball drop mechanisms and a slide bar assembly, each ball drop mechanism comprising: at least one ball chute, at least one ball catch arm adjacent the ball chute, and a catch arm mechanism in communication with the at least one ball catch arm, each ball drop mechanism being slideable on a slide bar of the slide bar assembly; (c) an electronic controller-power system in communication with the ball release apparatus, the controller-power system comprising a variable mode controller and a power supply; and (d) a separate foot-activated mechanism in communication with the controller; wherein activation of the foot-activated mechanism activates the catch arm mechanism, which opens a bottom ball chute hole in the ball chute; the ball release arm portion supports the slide bar assembly and two of the at least two movable ball chutes, each ball chute being slidable on the slide bar of the slide bar assembly, each ball chute being a part of a ball drop mechanism, the ball drop mechanisms being independently moveable along the slide bar; and wherein the catch arm mechanism comprises at least one solenoid in communication with a movable upper ball unit of the ball drop mechanism, the upper ball unit being movable using the ball drop solenoid.

9. The batting practice assembly according to claim 8, wherein a moveable solenoid arm of a solenoid switch mechanism extends through a solenoid arm hole in a side of the upper ball unit, the solenoid arm comprising a solenoid arm stop at a free end of the solenoid arm, an upper end portion of the lower catch arm being attached to the upper ball unit.

10. The batting practice assembly according to claim 9, wherein the foot-activated mechanism comprises a foot-depressible plate, depression of the foot-depressible plate activating a solenoid switch mechanism of the ball drop solenoid.

11. The batting practice assembly according to claim 10, wherein the foot-activated mechanism further comprises a timer with a delay period of up to about ten seconds, activation of the solenoid switch mechanism being delayed until the end of the delay period, if any has been set.

12. The batting practice assembly according to claim 10, wherein a control panel of the controller comprises: a Ball Drop Delay Control switch, the Ball Drop Delay Control switch comprising three alternative positions: "no delay", "delay", and "random"; and a Probability dial for use with the "random" switch position, the Probability dial comprising percentage settings for selecting probabilities of ball drops from the ball chutes.

13. The batting practice assembly according to claim 12, the control panel further comprising a Delay time dial for selecting a less than one second delay time between depression of the foot-depressible plate and signaling the ball drop solenoid to move the lower catch arm to the release position, the Delay time dial being useable when the Ball Drop Delay Control switch is in the "random" switch position.

14. The batting practice assembly according to claim 9, wherein the ball drop mechanism further comprises a stationary lower ball unit that is beneath the upper ball unit, the lower ball unit being attached to the moveable ball chute; wherein the ball chute is substantially vertical, and a lowermost ball in the ball chute is released through the bottom ball chute hole when the catch arm moves to a release position; and wherein a portion of the moveable first ball catch arm extends through a first slot in the ball chute and is moveable beneath the lowermost ball in the ball chute when the solenoid switch mechanism is activated, so that the first catch arm is an alternate, catch position.

15. The batting practice assembly according to claim 14, wherein the first ball catch arm is movable away from the catch position beneath the lowermost ball in the ball chute, to the release position away from the lowermost ball in the ball chute; and wherein the lowermost ball drops out of the ball chute.

16. The batting practice assembly according to claim 14, wherein, when the solenoid switch is deactivated, at least one tubular spring in the upper ball unit adjacent a side of the ball chute opposite the solenoid switch mechanism returns the upper ball unit to a steady state position in line with the lower ball unit, causing a second ball in the ball chute to drop and rest on the first, lower catch arm in the catch position.

17. The batting practice assembly according to claim 8, further comprising a Solenoid Selector Control switch on a control panel of the controller, the Solenoid Selector Control switch comprising the following positions: "BDS1", where a first one of the ball drop solenoids is activated, which moves the lower catch arm of the first ball chute to the release position; "S1/random/S2", where either the first or a second one of the ball drop solenoids is activated and ball drop is random from either ball chute; and "BDS2", where the second ball drop solenoid is activated, which moves the lower catch arm of the second ball chute to the release position.

18. The batting practice assembly according to claim 17, further comprising a probability BDS1/BDS2 potentiometer control dial on the control panel for use with the "random" setting of the Solenoid Selector Control switch, the probability BDS1/BDS2 potentiometer control dial comprising markings at least at 80/20, 50/50, and 20/80 for selecting a percent probability that a ball will drop from the first chute/second ball chute.

19. The batting practice assembly according to claim 8, further comprising a "1 2 OFF" stride/no stride switch on a control panel of the controller, the 1 2 OFF switch comprising a first position in which depression of the foot-depressible plate triggers a ball drop, and an alternative second position in which ball drop is delayed for a pre-set time period.

20. The batting practice assembly according to claim 8, wherein the controller comprises a No-ball Control switch module comprising a No-ball Control switch on a control panel of the controller, the No-ball Control switch comprising three positions: a "Ball" position in which a ball drops each time the foot-depressible mechanism is activated, a "No-ball" position in which the ball drop solenoids are deactivated and no ball drops from the ball chutes, and a "random" position in which ball drop is random, the control panel further comprising a Probability dial for use with the "random" switch position.

* * * * *